United States Patent [19]

Mikelsons et al.

[11] 4,331,753

[45] May 25, 1982

[54] METHOD FOR PROVIDING AN ELECTRICAL CHARGE PATTERN ON THE INSULATIVE LAYER OF AN INSULATIVE LAYER-PHOTOCONDUCTIVE LAYER-CONDUCTIVE LAYER STRUCTURE

[75] Inventors: Valdis Mikelsons, Mendota Heights; Owen L. Nelson, St. Paul, both of Minn.

[73] Assignee: Minnesota Mining and Manufacturing Company, St. Paul, Minn.

[21] Appl. No.: 963,897

[22] Filed: Nov. 27, 1978

[51] Int. Cl.[3] ..... G03G 13/02; G03G 13/24

[52] U.S. Cl. ..... 430/55; 430/902; 361/225; 355/3 CH

[58] Field of Search ..... 430/48, 55, 902; 361/225; 355/3 CH

[56] References Cited

U.S. PATENT DOCUMENTS

| | | | |
|---|---|---|---|
| 2,904,431 | 9/1959 | Moncrieff-Yeates | 430/902 |
| 3,398,336 | 8/1968 | Martel et al. | 430/902 X |
| 3,457,070 | 7/1969 | Watanabe et al. | 430/55 |
| 3,539,255 | 11/1970 | Goffe | 430/55 X |
| 4,222,776 | 9/1980 | Tsukada et al. | 430/55 |

*Primary Examiner*—Roland E. Martin, Jr.
*Attorney, Agent, or Firm*—Cruzan Alexander; Donald M. Sell; Robert L. Marben

[57] ABSTRACT

A system and method using an integral sandwich structure including an insulative layer-photoconductive layer-conductive layer. A removable electrode member is positioned above and connected to the insulative layer by a thin liquid layer having a dipole moment greater than zero, a conductivity sufficient to maintain the electric potential of the surface of the insulative layer at the potential of the electrode member, a surface tension equal to or smaller than the critical surface tension of the insulative layer. Upon removal of the electrode member the liquid evaporates in a time period less than the dark dielectric time constant of the photoconductive insulative layer. A d.c. voltage is applied between the conductive layer and the removable electrode during which time a radiation image is applied to the photoconductive layer to cause an electrical charge image to be produced at the outer surface of the insulative layer. The method then requires removal of the electrode member and after evaporation of the liquid, the photoconductive layer of the structure is subjected to overall radiation.

4 Claims, 4 Drawing Figures

METHOD FOR PROVIDING AN ELECTRICAL CHARGE PATTERN ON THE INSULATIVE LAYER OF AN INSULATIVE LAYER-PHOTOCONDUCTIVE LAYER-CONDUCTIVE LAYER STRUCTURE

BACKGROUND OF THE INVENTION

1. Field of the Invention

The invention disclosed herein relates to electrophotography and electroradiography and in particular to a system and method for creating an electrical charge pattern in accordance with a radiation image pattern on the insulative layer of an integral sandwich structure including an insulative layer-photoconductive layer-conductive layer.

2. Prior Art

Prior approaches to the creation of an electrical charge pattern in accordance with a radiation-image pattern on the insulative layer of an integral sandwich structure including an insulative layer-photoconductive layer-conductive layer have involved the use of corona discharge devices as a charge source and in some cases more than one type of corona discharge devices. A radiation image pattern is used during a period of operation of the corona discharge device. Such prior approaches are described in two articles appearing in IEE Transactions on Electron Devices, Vol. ED-19, No. 4, April 1972. The first article is found at page 396 and the second article at page 405.

Such prior approaches to the creation of an electrical charge pattern on the insulative layer of insulative layer-photoconductive layer-conductive electrode structure do not provide for large area exposure if high quality gray scale reproduction is to be obtained. Such results require a charge source which must be capable of supplying a very uniform charge density proportional to the incident radiation.

Corona discharge devices are subject to geometric and wire surface irregularities and, therefore, do not lend themselves to large area charging without scanning and in addition the charge delivery rate of corona discharge devices is subject to variation due to environmental conditions, and is limited by corona design constraints.

The application of an electrical charge by placing a removable conductive surface in close proximity to the insulative layer while a voltage is applied to it with respect to the conductive layer is not acceptable due to variations in the air gap presented.

SUMMARY OF THE INVENTION

The present invention provides a system and method for creating an electrical charge pattern in accordance with a radiation image pattern on the insulative layer of an integral sandwich structure of an insulative layer-photoconductive layer-conductive layer which overcomes the problems presented by the prior known systems. The present invention provides for a removable conductive electrode member that is positioned in uniform contact with the insulative layer via a thin liquid layer wherein the liquid has a dipole moment greater than zero, a conductivity sufficient to maintain the electrical potential of the surface of the insulative layer effectively at the potential of the removable conductive electrode member, a surface tension equal to or smaller than the critical surface tension of the insulative layer, and the portion of liquid that remains on the insulative layer upon removal of the removable conductive electrode member evaporating in a time period that is less than the dark dielectric relaxation time constant of the photoconductive insulative layer. A d.c. voltage source is provided for presenting selected d.c. voltages between the conductive layer and the removable conductive electrode member. A radiation image source is provided for exposing the photoconductive layer to a radiation image when the structure is in a darkened environment with the removable conductive electrode member in position and a d.c. voltage applied between the conductive layer and the removable conductive electrode member to cause an electrical charge image to be produced at the insulative layer.

The method then requires removal of the removable conductive electrode member. The d.c. voltage level can be maintained or changed; for example, the removable conductive electrode member can be connected directly to the conductive layer as the electrode member is removed. Upon evaporation of the liquid from the insulative layer, the photoconductive layer is subjected to overall radiation before the electrical charge image at the insulating layer is revealed by electronic readout or development using a liquid or dry toner method.

BRIEF DESCRIPTION OF THE DRAWING

For a more complete understanding of the invention, reference should be made to the accompanying drawing, wherein like elements in each of the several figures are identified by the same reference numerals, and wherein.

DETAILED DESCRIPTION

Figure 1:
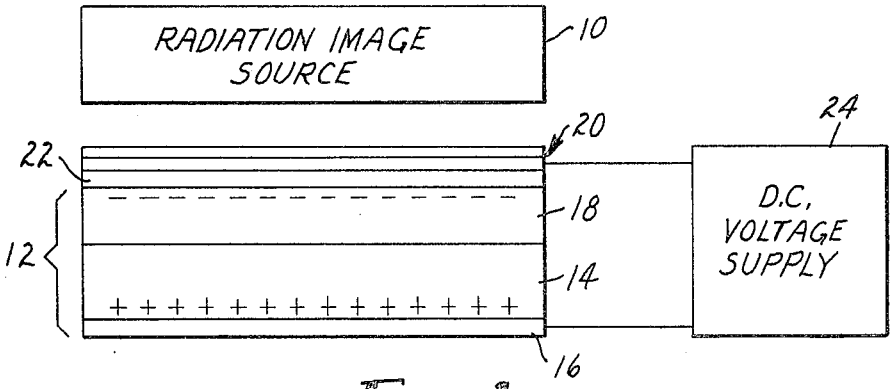
FIG. 1 is a schematic end view depicting the basic elements of the system of this invention and the electrical charge distribution for one step of the method of this invention.

Referring to the drawing, the system in accordance with this invention is shown which includes a radiation imaging source 10 positioned for directing a radiation image toward a multi-layered receptor structure 12 which includes a photoconductive layer 14 sandwiched between a conductive layer 16 and an insulating layer 18 with a removable conductive electrode member 20 positioned away from but in uniform area contact with the insulating layer 18 via a thin liquid layer 22. The system further includes a d.c. voltage supply 24 connected to supply selected voltage levels between the conductive layer 16 and the removable conductive electrode member 20. The conductive layer 16 or the electrode member 20 can provide the surface through which the radiation image is directed and, when so used, must be substantially transparent to the radiation energy. In FIG. 1 the system is shown with the radiation image source 10 positioned so the radiation is directed through the electrode member 20. In this case, the insulative layer 18 must also be substantially transparent to the radiation energy used so it can reach the photoconductive layer 14.

The system shown in FIG. 1 provides the means for carrying out the method of this invention for obtaining an electrical charge image at the surface of the insulative layer 18 adjacent the liquid interface in accordance with the radiation image provided by source 10. With the structure of FIG. 1 in an initial condition wherein any electrical charge present at any of the interfaces is substantially uniform, the method of this invention includes the step of providing a uniform high electrical field between the electrode member 20 and the conductive layer 16 in the absence of radiation to which the photoconductive layer is sensitive. This is accomplished in the arrangement shown in FIG. 1 by providing a d.c. voltage from the d.c. voltage supply 24. The polarity of the voltage that is applied may be dictated by the material used for the photoconductive layer 14. For purposes of illustration the d.c. voltage supply 24 is connected to provide a positive voltage to conductive layer 16 with respect to the electrode member 20. The electrical charge distribution that is then established is diagrammatically shown in FIG. 1 by the minus and plus signs wherein the charge adjacent the conductive layer 16 and electrode 20 resides substantially at the interface of layers 14 and 16 and layers 18 and 22 respectively.

Figure 2:
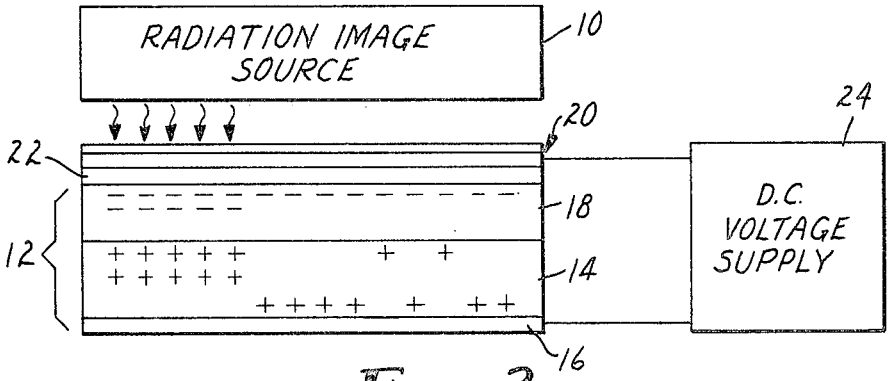
FIG. 2 shows the structure of FIG. 1 with the electrical charge distribution shown in response to a radiation image.

The next step of the method of this invention requires operation of the radiation imaging source to expose the photoconductive layer 14 to a radiation image while the d.c. potential from the supply 24 remains applied between the electrode member 20 and the conductive layer 16. The radiation image receiving structure of this invention is capable of receiving the radiation image simultaneously over its entire area. The radiation absorbed by the photoconductive layer 14 causes the conductivity of the areas receiving radiation to increase allowing the charge carriers at the outer surface of the photoconductive layer 14 to move under the influence of the applied electric field toward the upper surface of the photoconductive layer and thus establish an induced electrical charge image at the upper surface of the insulative layer 18. The increased conductivity of the areas of the photoconductive layer 14 can be viewed as reducing the effective thickness of the capacitor provided between the conductive layer 16 and the electrode member 20. Maintaining the uniform d.c. voltage at the surface of the insulative layer 18 adjacent to the liquid layer 22 requires that additional charges flow to the areas where the radiation energy is absorbed. The d.c. voltage level and the total exposure to radiation at a given area of the photoconductive layer 14 will determine the amount of the charge that is moved through the photoconductive layer so that in effect a time integration of the radiation energy received by the photoconductive layer 14 is accomplished. FIG. 2 is provided to show the application of a radiation image and the final disposition of charges due to the radiation image that is absorbed by the photoconductive layer. The area receiving radiation is indicated by the arrows shown in FIG. 2. The spurious positive charges at the upper portion of layer 14 not receiving radiation indicate the charge that may drift to such position due to the high electrical field that is present and the dark current of the photoconductive layer 14.

Figure 3:
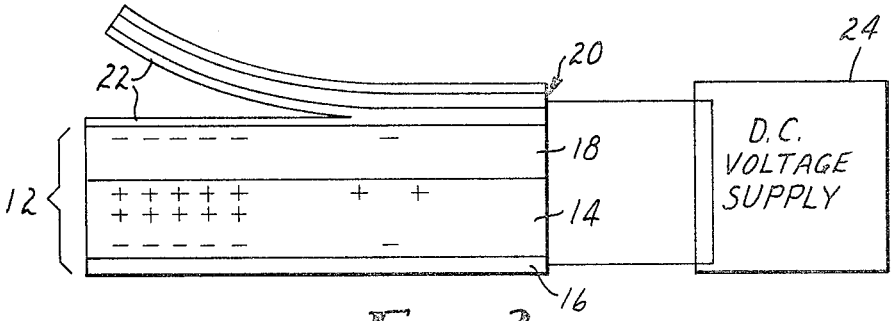
FIG. 3 shows a portion of the system of FIG. 1 with removal of the removable conductive electrode depicted along with the electrical charge distribution then existing.

Immediately after the image radiation step or before the charge pattern is significantly altered by dark current, the removable electrode member 20 is removed from the insulative layer 18, for example, by peeling away, while the removable electrode member 20 and the conductive layer 16 are effectively electrically connected together or held at an electrical potential which is the same or different than the potential utilized during the radiation imaging step. An advantage can be obtained when the potential applied between the electrode member 20 and the conductive layer 16 is reduced in magnitude before the electrode member 20 is removed. Such a change in the potential can significantly reduce the spurious noise of the resultant image by reducing the charge variations arising from layer capacitance fluctuations. The most significant reduction in spurious noise is obtained when the applied potential is returned to the level present prior to the application of the potential used during the radiation image exposure step. The method selected to read-out or develop the latent electrical charge image provided by the method of this invention can also be a factor influencing the potential selected for application between the electrode member 20 and the conductive layer 16 during removal of the electrode member 20. For example, by proper selection of such potential, any bias voltage requirements during read-out or operation of the development apparatus can be minimized. In FIG. 3 illustrating the step of removing the electrode member 20, the d.c. voltage supply 24 is shown as presenting zero voltage with the electrode member 20 and the conductive layer 16 directly connected together. The liquid layer 22 splits as the electrode member 20 is removed leaving appropriate charges on both the surface of the insulative layer 18 and the electrode member 20 so they are at the same potential. Hence, no sparking or spurious discharges are obtained. The very thin liquid layer residue that remains on the surface of the insulative layer 18 evaporates leaving behind a real electrical charge pattern on the surface of the insulative layer 18. This charge pattern is an accurate representation of the radiation-induced charge pattern which remains immobilized at the juncture of the insulative layer and the photoconductive layer after evaporation of the liquid and which has a charge density variation that is an accurate representation of the radiation image. The electrical charge distribution that is then presented is shown in FIG. 3. This showing assumes that the dark decay time of the photoconductive layer is very long compared to the time required to carry out the sequential steps thus far described.

Figure 4:
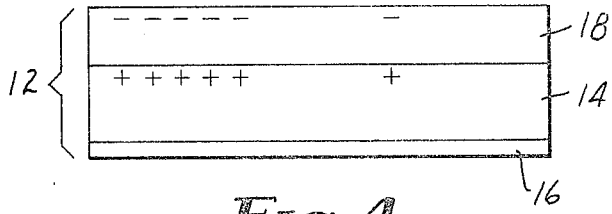
FIG. 4 is a showing of the arrangement of FIG. 3 at a later time wherein the removable conductive electrode has been completely removed and the structure has been exposed to radiation.

Since a long dark decay rate is assumed, the effect of the dark decay rate of the photoconductive layer 14, at this point will result in only a slight difference in electrical charge between the upper surface of the insulative layer 18 and the lower surface of the photoconductive layer 14. A sufficient difference is necessary in order that the electrical charge pattern can be revealed or read-out in some manner. As shown by the electrical charge pattern in FIG. 3, an image-wise internal electrical field is present across the photoconductive insulator. By merely waiting for a period of time, dependent on the dark decay rate of the photoconductive layer, the charge at the bottom conductor 16 will recombine with charges at the interface of the photoconductive layer 14 and the insulative layer 18 to cause the charge distribution as shown in FIG. 4 to be presented at which time the maximum difference in potential between the upper surface of the insulative layer 18 and the conductor 16 will be present allowing the electrical charge image at the surface of the insulative layer to be read-out or revealed by a liquid or dry toner development system or other development means. Of course, it is only necessary to wait until a difference in electrical potential exists between the upper surface of the insulative layer 18 and the conductive layer 16 as may be required by the development system used before developing the electrical charge image at the surface of the insulative layer 18. Further, if the dark decay time of the photoconductive layer 18 is quite short, a sufficient electrical potential difference may be present between the upper surface of the insulative layer 18 and the conductive layer 16 by the time the liquid has evaporated following removal of the electrode member 20 to enable the electrical charge image at the surface of the insulative layer to be developed immediately following the evaporation of the liquid from the insulative layer 18.

The process of moving the charge from the conductive layer 16 to the interface of the photoconductive layer 14 and the insulative layer 18 can be speeded up by subjecting photoconductive layer 14 of the structure to overall or flood radiation after the liquid on the surface of the insulating layer has evaporated. The electrical charge image at the surface of the insulative layer 18 can thus be developed immediately after the structure is subjected to radiation.

It is desirable that the liquid layer 22 be thin to facilitate rapid evaporation after removing electrode member 20, and to reduce its electrical resistance. A suitable thickness for the liquid layer can be obtained by first placing the liquid on the insulative layer 18, then placing the electrode member 20 over the liquid and finally drawing a squeegee across the upper surface of the electrode member 20.

After the electrode member 20 is removed the liquid remaining on the surface of the insulative layer 18 must evaporate in a time less than the dark dielectric relaxation time constant of the photoconductive layer 14. The time needed for evaporation depends on the thickness of the remaining liquid and the equilibrium vapor pressure of the liquid at the operating conditions. Using the liquid layer application method described, that of drawing a squeegee across the electrode member 20, evaporation times and thicknesses of the liquid layer 22 were measured for several liquids. Thickness values were typically between 0.3 and 1.0 $\mu$m. An empirical relationship was determined from the measurements which can be used as a guide for selecting suitable liquids. The empirical relationship found is as follows:

$$\text{Evaporation time in seconds} = \frac{10 \times \text{thickness of layer 22 in } \mu\text{m}}{\text{vapor pressure at operating conditions in mmHg}}$$

Other factors must be satisfied by a liquid to be suitable for use in the system and method of this invention. It has been found that liquids useable with this invention must have a dipole moment greater than zero. It has been found that the magnitude of dipole moment influences the speed at which the method of this invention can be carried out. Liquids with a dipole moment of $1.0\times10^{-18}$ esu or greater are used when voltage application and exposure times of about one second or less are used. The liquid should also have a degree of electrical conductivity capable of maintaining the electrical potential of the surface of the insulative layer 18 effectively at the potential of the electrode member 20. In the examples to be described, liquids having a conductivity of $10^{-7}$(ohm-centimeter)$^{-1}$ or greater were found to be adequate to provide the function required with respect to the conductivity of the liquid. It is also necessary that the liquid used for the liquid layer 22 "wets" the surface, i.e., spreads over the surface. This liquid-solid interaction is controlled by the relationship between the surface energy of the solid and the surface tension of the liquid as well as the roughness of the solid surface. For smooth surfaces it is generally true that a low surface tension liquid will tend to spread over a high surface energy solid. The degree of spreading can be characterized by measuring the contact angle formed by a drop of the liquid on the solid surface. The smaller the contact angle the better the liquid wets the surface. W. A. Zisman and H. W. Fox have used the concept of a "critical surface tension $\gamma_c$" to describe the process of wetting. The $\gamma_c$ values are obtained by measuring the contact angles formed by a series of well-defined liquids on the solid surface and then plotting the cosine of the contact angles against the surface tensions $\gamma_L$ of the respective liquid. The $\gamma_L$ value for which the plot intercepts the line for the cosine of the contact angle equal to one is defined as the "critical surface tension $\gamma_c$". Accordingly, the "critical surface tension $\gamma_c$"is the parameter which characterizes the solid surface and its numerical value has the meaning that a liquid which has the surface tension $\gamma_L$ equal or smaller than $\gamma_c$ will spread on the solid surface. Further details regarding the use of "critical surface tension $\gamma_c$" to describe the process of wetting can be found in an article by H. W. Fox and W. A. Zisman in the Journal of Colloid Science, Vol. 5, page 514 (1950) and in an article by W. A. Zisman in the Journal of Paint Technology, Vol. 44, No. 564, page 42 (1972). The critical surface tension for polyester (polyethylene terephthalate) has been measured as approximately 44 dynes per centimeter. Therefore, a large number of liquids which have a surface tension less than the critical surface tension of polyester are useable as a liquid for the liquid layer 22 when polyester is used for the insulative layer 18 provided they also satisfy the other requirements which have been discussed.

A suitable removable electrode member 20 can be provided by a thin flexible sheet material, for example, a polyester sheet which has one side vapor coated with a metal such as aluminum or chromium. The metal coating, of course, is placed in contact with the liquid interface 22. The polyester sheet allows the electrode member 20 to conform to the surface of the insulative layer 18 and its flexibility is also of help in forming the liquid layer 22 and removal of the electrode 20. A substantially rigid material can be used in place of the polyester sheet, but a structure that provides a conformable electrode member 20 that is flexible is preferred.

In the event that d.c. voltage magnitude selected for use at the time the removable conductive electrode is removed, also requires a polarity opposite to that used during the exposure step, the d.c. voltage source 24 is used to impress a d.c. voltage of such magnitude and polarity between the electrode member 20 and the conductive layer 16 prior to the application of the d.c. voltage used during the radiation image exposure step.

It will be obvious to those skilled in the art that the voltage impressed between electrode member 20 and the conductive layer 16 can be of any polarity and magnitude prior to exposure, during exposure, and after exposure and during electrode member removal, as long as the electrical potentials do not cause electrical breakdown damage to the layers and provide an electrical field across the photoconductive layer during exposure to ensure electrical charge flow.

While the system and method of this invention has been described wherein the layer 14 has been illustrated using a photoconductive layer, it is to be understood that the system and method of this invention is also applicable to the use of materials for layer 14 which provide essentially the same function as the photoconductive layer, i.e., layer 14 can be any material that responds to the image radiation to cause a charge pattern to be induced image-wise on the insulating layer 18 interface adjacent the liquid layer 22. Thus, for example, layer 14 could be a material which exhibits a change in its dielectric constant in response to radiation, such as an increase in dielectric constant in those areas receiving greater radiation. Another example of a material for layer 14 is one which exhibits a photovoltage in the presence of radiation in which case the photovoltage will aid or impede the electric field applied between the electrode member 20 and the conductive layer 16 and thus cause an image-wise induced charged pattern to be established at the insulating layer 18 at the interface with the liquid layer 22.

These and other radiation responsive layers, singly or in combination, could be successfully utilized by one skilled in the art according to the teachings of this invention.

For purposes of the system and method of this invention, the insulative layer 18 can be formed from any material which will not support charge flow for a time period sufficient to form the electrical charge image at the surface of the insulative layer 18 and read-out or develop the image.

To illustrate the invention, the following non-limiting examples are provided:

EXAMPLE 1

A slurry of lead oxide (PbO) pigment, a binder of styrene butadiene copolymer, for example, Pliolite S-7 binder available from the Goodyear Company, and toluene is prepared with a 10:1 pigment to binder ratio by weight. The slurry is then coated onto a 25 μm thick polyester sheet to provide the photoconductive layer 14 and the insulative layer 18. When dry, the coating is approximately 100 μm thick. This dried coating is then overcoated with a slurry of electrically conductive carbon black and polyvinyl butyral in methanol to provide an electrically conductive contact. A polyvinyl butyral available from the Monsanto Company under the designation B76 Butvar polyvinyl butyral can be used. The ratio of carbon black to polyvinyl butyral is 1:1 by weight. With the polyester surface exposed, this layered structure is then mounted onto an aluminum plate such that the carbon coating makes contact with an aluminum plate which serves as the conductive layer 16.

The polyester surface is then wetted with isopropyl alcohol and contacted with the aluminum surface of a removable electrode member 20 consisting of 25 μm thick polyester sheet vapor-coated with aluminum. Uniform contact is then assured by drawing a squeegee across the removable electrode member to provide a thin uniform layer 22 of isopropyl alcohol. Isopropyl alcohol has a surface tension of 20.4 dynes/cm which is less than the critical surface tension of polyester (or 44 dynes/cm).

In a darkened environment, a voltage of 1000 volts d.c. is applied between the aluminum plate and the aluminum coating of the removable electrode member so the aluminum coating is at a negative polarity. Simultaneously to the voltage application, the device is subjected to a radiation image. When using x-rays to image, a 57 $KV_p$ source, 1/15 second, 25 ma exposure with a 100 cm source to device distance is utilized. Immediately after exposure to imaging radiation, the applied voltage is reduced to zero volts in a manner effectively directly connecting the aluminum coating to the aluminum plate. At the same time the removable electrode member is removed by a peeling, mechanical translation of approximately 25 cm/sec.

After the removable electrode member has been removed and the isopropyl alcohol evaporates, the room lights are turned on and the image-related charge (surface voltage) pattern is scanned using a Monroe electrostatic voltmeter. The surface voltage in an area which had received the x-ray exposure is 325 volts with respect to the aluminum plate, whereas the surface voltage in a region protected by a 0.63 cm thick lead bar is 300 volts indicating, therefore, a contrast of 25 volts. Alternately, when the device containing the electrical charge pattern is passed through a development apparatus, a clearly discernible image of the lead bar, and other x-ray absorbing objects that may be used, is obtained.

EXAMPLE 2

A slurry of lead oxide (PbO) pigment, a binder of styrene butadiene copolymer, for example, Pliolite S-7 binder available from the Goodyear Company, and toluene is prepared with a 7.5:1 pigment to binder ratio by weight. The slurry is then coated onto a 25 μm thick polyester sheet to provide the photoconductive layer 14 and the insulative layer 18. When dry, the coating is approximately 70 μm thick. This dried coating is then overcoated by vacuum deposition with a thin conducting copper film to provide an electrically conductive contact. With the polyester surface exposed, this layered structure is then mounted onto an aluminum plate such that the copper film makes contact with the aluminum plate.

A removable electrode member is then prepared by vapor coating a thin layer of chromium onto a 25 μm thick polyester sheet. The optical transmission of the chromium coated electrode member is approximately 20 percent. Isopropyl alcohol is then used to wet the exposed polyester surface which is then contacted by the chromium surface of the electrode member. The conductive isopropyl alcohol liquid layer is then made thin by passing a squeegee over the electrode member. A light source is mounted above the image producing assembly and arranged to direct an image-wise light pattern on the electrode member when a shutter is opened.

In a darkened environment, a voltage of −1000 volts is applied to the chromium coating of the electrode member with respect to the conducting aluminum plate. While the voltage is applied, the device is subjected to imaging radiation by opening the shutter on the light source for 0.2 seconds to produce an exposure of approximately one foot candle second. Immediately after exposure to imaging radiation, the applied voltage is reduced to zero volts in a manner that directly connects the chromium coating to the aluminum plate, and the electrode member removed as in Example 1.

After the remnant film of isopropyl alcohol evaporates, the room lights are turned on. The image-related charge pattern is scanned by an electrostatic voltmeter which reveals a contrast of approximately 100 volts between the exposed and unexposed areas. Alternately, the image-related charge pattern can be revealed utilitizing a development apparatus.

EXAMPLE 3

A slurry of cadmium sulfide (CdS) pigment, a binder of styrene butadiene copolymer and toluene is prepared with 10:1 pigment to binder ratio by weight. A thin coating of the slurry is placed on a 25 μm thick polyester sheet and dried to provide the photoconductive layer 14 and insulative layer 18. The dried CdS layer is about 50 μm thick. The coating is then overcoated with a slurry of electrically conductive carbon black and polyvinyl butyral in methanol on which an aluminum backing plate is placed to provide the conductive layer 16.

The polyester surface 18 is then wetted with isopropyl alcohol and is contacted with the tin oxide ($SnO_2$) surface of a removable electrode member consisting of a transparent $SnO_2$ coating on a 75 μm polyester. A squeegee is then drawn across the electrode member to provide a thin (about 1 μm) uniform layer of the isopropyl alcohol. A light source is mounted above the image producing assembly and arranged to direct an image-wise light pattern on the electrode member when a shutter is opened.

In a darkened environment, a voltage of −1000 volts is applied to the $SnO_2$ coating of the electrode member with respect to the aluminum plate. While the voltage is applied, the device is subjected to light image that provides a maximum exposure of about 0.2 foot candle second. Within one second the voltage is reduced to zero in a manner that directly connects the $SnO_2$ coating to the aluminum plate and the removable electrode member is removed as in Example 1. Within about another 5 seconds during which time the isopropyl alcohol remaining on the polyester 18 has evaporated, the room lights are turned on. The latent electrical charge image on the polyester surface is revealed by the use of a liquid toner development assembly. The resulting image shows seven steps of a 0.3 optical density tablet, with a maximum optical density of 2.3 in transmission.

EXAMPLE 4

A slurry of lead oxide (PbO) pigment and binder is prepared using 20 grams pigment, 10 grams isopropyl alcohol, 3.8 grams of 35% (wt.) acrylic resin (Rohm and Haas "WR-97") in isopropyl alcohol, and 0.13 grams of a plasticizer (Rohm and Haas "Paraplex G-30"). After ball-milling to disperse the ingredients the slurry is coated onto a 25 μm thick sheet of polyester. After the solvent evaporates, a 40 μm coating remains of pigment and binder in a ratio of 15:1 by weight. This coating is then overcoated with a slurry of electrically conductive carbon black and a polyvinyl butyral binder in a ratio of 1:1 by weight. After drying this layered structure is then mounted onto an aluminum plate so that the carbon coating contacts the aluminum and the polyester surface is exposed.

The polyester surface is then wetted with isopropyl alcohol and contacted with the aluminum surface of a removable electrode member consisting of 25 μm thick polyester sheet, vapor coated with aluminum. Uniform contact and a thin layer of liquid are assured by drawing a squeegee across the back of the electrode member to provide a thin uniform interface film of approximately 0.5 μm of isopropyl alcohol.

In a darkened environment, a voltage of 1000 volts is applied across the layered structure by connecting the negative lead to the aluminum coating of the electrode member and the positive lead to the aluminum plate. The voltage remains on for 2 seconds. Within 0.3 second after voltage application the device is subjected to an x-ray exposure of 0.1 second, 25 mA, 80 KVp, 100 cm source-to-device distance. 1.5 seconds after voltage application the electrode member is removed from the polyester surface by a mechanical peeling action requiring about 0.3 second. Thus, the electrode member is removed while held at the exposure potential of −1000 volts. Approximately 2 seconds later the room lights are turned on.

The charge pattern which has been created is measured by scanning using a Monroe electrostatic voltmeter. The surface voltage in an area subject to full x-ray exposure is −460 volts with respect to the aluminum plate, and in an area protected from x-rays by a 0.63 cm thick lead bar, is −410 volts, giving a 50 volt contrast.

The removable electrode member is applied again, an initial condition of zero volts applied between the electrodes during a flood exposure is established, and a new exposure to radiation is made, this time for 0.2 seconds. This step is repeated for 0.4 sec., 0.7 sec., and 1.0 sec. exposures, with all other listed conditions held the same. The results showing electrical potential contrast response to increasing exposure, are shown in the table below:

| Exposure time, seconds | 0.1 | 0.2 | 0.4 | 0.7 | 1.0 |
|---|---|---|---|---|---|
| Voltage in exposed area | −460 | −510 | −570 | −675 | −725 |
| Voltage in protected area | −410 | −425 | −410 | −430 | −435 |
| Contrast voltage | 50 | 85 | 160 | 245 | 290 |

The exposure steps are repeated again, with 0.4 sec. exposure, and with the voltage on the electrode member held at −1000 volts for 3 sec., then reduced to 0 volts, and the electrode member stripped off at 4.0 sec. This example illustrates the optional step of electrically connecting the electrode member directly to the aluminum plate. The measured voltages are −175 volts in an exposed area, −50 volts in a protected area for a contrast of 125 volts. The voltmeter traces show the scanned areas to have more uniform potential patterns.

What is claimed is:

1. A method for establishing electrical charge image including the steps of:

providing a multi-layered structure having a conductive layer, a photoconductive layer and an insulative layer in that order;

positioning a removable conductive electrode member in uniform contact with said insulative layer via a thin liquid layer wherein the liquid has a dipole moment greater than zero, a conductivity sufficient to maintain the electrical potential of the surface of said insulative layer effectively at the electrical potential of said removable conductive electrode member, a surface tension equal to or smaller than the critical surface tension of said insulative layer and with the liquid of said liquid layer that remains at said insulative layer upon removal of said removable electrode member evaporating in a time period that is less than the dark dielectric relaxation time constant of said photoconductive insulative layer;

exposing said photoconductive layer to a radiation image while applying a d.c. voltage between said conductive layer and said removable conductive electrode member to produce an electrical charge image at said insulative layer;

reducing the magnitude of the d.c. voltage applied between said conductive layer and said removable conductive electrode member;

removing said removable conductive electrode member; and removing any liquid then remaining on said insulative layer by evaporation.

2. A method for establishing electrical charge image including the steps of:

providing a multi-layered structure having a conductive layer, a photoconductive layer and an insulative layer in that order;

positioning a removable conductive electrode member in uniform contact with said insulative layer via a thin liquid layer wherein the liquid has a dipole moment greater than zero, a conductivity sufficient to maintain the electrical potential of the surface of said insulative layer effectively at the electrical potential of said removable conductive electrode member, a surface tension equal to or smaller than the critical surface tension of said insulative layer and with the liquid of said liquid layer that remains at said insulative layer upon removal of said removable electrode member evaporating in a time period that is less than the dark dielectric relaxation time constant of said photoconductive insulative layer;

exposing said photoconductive layer to a radiation image when a d.c. voltage is applied between said conductive layer and said removable conductive electrode member to produce an electrical charge image at said insulative layer;

removing said removable conductive electrode member; and removing any liquid then remaining on said insulative layer by evaporation.

3. A method for establishing electrical charge image including the steps of:

providing a multi-layered structure having a conductive layer, a photoconductive layer and an insulative layer in that order;

positioning a removable conductive electrode member in uniform contact with said insulative layer via a thin liquid layer wherein the liquid has a dipole moment greater than zero, a conductivity sufficient to maintain the electrical potential of the surface of said insulative layer effectively at the electrical potential of said removable conductive electrode member, a surface tension equal to or smaller than the critical surface tension of said insulative layer and with the liquid of said liquid layer that remains at said insulative layer upon removal of said removable electrode member evaporating in a time period that is less than the dark dielectric relaxation time constant of said photoconductive insulative layer;

applying a d.c. voltage of one level between said removable conductive electrode member and said conductive layer;

exposing said photoconductive layer to a radiation image while applying the d.c. voltage between said conductive layer and said removable conductive electrode member at a level different than said one level to produce an electrical charge image at said insulative layer;

removing said removable conductive electrode member; and removing any liquid then remaining on said insulative layer by evaporation.

4. A method for establishing electrical charge image including the steps of:

providing a multi-layered structure having a conductive layer, a photoconductive layer and an insulative layer in that order;

positioning a removable conductive electrode member in uniform contact with said insulative layer via a thin liquid layer wherein the liquid has a dipole moment greater than zero, a conductivity sufficient to maintain the electrical potential of the surface of said insulative layer effectively at the electrical potential of said removable conductive electrode member, a surface tension equal to or smaller than the critical surface tension of said insulative layer and with the liquid of said liquid layer that remains at said insulative layer upon removal of said removable electrode member evaporating in a time period that is less than the dark dielectric relaxation time constant of said photoconductive insulative layer;

exposing said photoconductive layer to a radiation image while applying a d.c. voltage between said conductive layer and said removable conductive electrode member to produce an electrical charge image at said insulative layer;

removing the d.c. voltage that is applied between said conductive layer and said removable conductive electrode member;

connecting said removable conductive electrode member directly to said conductive layer;

removing said removable conductive electrode member; and removing any liquid then remaining on said insulative layer by evaporation.

* * * * *

UNITED STATES PATENT AND TRADEMARK OFFICE

CERTIFICATE OF CORRECTION

PATENT NO. : 4,331,753

DATED : May 25, 1982

INVENTOR(S) : VALDIS MIKELSONS and OWEN L. NELSON

It is certified that error appears in the above—identified patent and that said Letters Patent is hereby corrected as shown below:

In column 11 delete lines 13-40 and substitute -- 2. A method for establishing an electrical charge image in accordance with claim 1 wherein said photoconductive layer is subjected to radiation after the liquid on said insulative layer has evaporated following removal of said removable conductive electrode member.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*